US010529513B1

(12) United States Patent
I

(10) Patent No.: US 10,529,513 B1
(45) Date of Patent: Jan. 7, 2020

(54) OVERHEATING DESTRUCTIVE SWITCH

(71) Applicant: GREEN IDEA TECH INC., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

(21) Appl. No.: 16/233,087

(22) Filed: Dec. 27, 2018

(30) Foreign Application Priority Data

Oct. 2, 2018 (TW) ..... 107134826 A

(51) Int. Cl.

| | |
|---|---|
| ***H01H 37/32*** | (2006.01) |
| ***H01H 37/76*** | (2006.01) |
| ***H01R 13/713*** | (2006.01) |
| ***H01H 85/08*** | (2006.01) |
| ***H01H 13/20*** | (2006.01) |

(52) U.S. Cl.
CPC ..... *H01H 37/32* (2013.01); *H01H 13/20* (2013.01); *H01H 37/76* (2013.01); *H01H 85/08* (2013.01); *H01R 13/7137* (2013.01)

(58) Field of Classification Search
CPC ..... H01H 37/32; H01H 13/20; H01H 37/76; H01H 85/08; H01R 13/7137
USPC ..... 337/298
See application file for complete search history.

(56) References Cited

U.S. PATENT DOCUMENTS 4,288,833 A * 9/1981 Howell ..... H02H 9/06 337/16
4,295,114 A * 10/1981 Pohl ..... H01H 37/764 337/3
4,472,705 A * 9/1984 Carlson ..... H01H 37/002 337/299
4,528,538 A * 7/1985 Andersen ..... H01H 73/26 337/2
4,833,439 A * 5/1989 Bowden ..... H01H 73/26 337/56
4,876,523 A * 10/1989 Kushida ..... H01H 37/002 337/299

(Continued)

FOREIGN PATENT DOCUMENTS

JP 01279532 A * 11/1989 ..... H01H 37/002

*Primary Examiner* — Anatoly Vortman
(74) *Attorney, Agent, or Firm* — Michael D. Eisenberg

(57) ABSTRACT

An overheating destructive switch, which comprises: a base, a first conductive member, a second conductive member, a movable conductive member, an overheating destructive member, an operating component, and a second elastic member. The movable conductive member connects the first conductive member and the second conductive member, and the operating component comprises an operating member and a first elastic member. The first elastic member is compressed and confined between a contact member and the overheating destructive member, and is provided with a first elastic force. A second elastic force of the second elastic member acts on the operating member. The overheating destructive member is destructed under a fail temperature condition, resulting in lessening or loss of the first elastic force, whereupon the second elastic force forces the operating member to displace, which causes the movable conductive member to separate from the second conductive member to form a power-off state.

7 Claims, 16 Drawing Sheets

(56) References Cited

U.S. PATENT DOCUMENTS 5,196,820 A * 3/1993 Ubukata ..... H01H 37/002 337/3
5,221,914 A * 6/1993 Ubukata ..... H01H 37/002 337/13
5,262,748 A * 11/1993 Tsung-Mou ..... H01H 73/26 337/66
5,264,817 A * 11/1993 Sorenson ..... H01H 73/26 337/68
5,391,847 A * 2/1995 Gallone ..... H01H 1/5833 200/244
5,847,638 A * 12/1998 Sorenson ..... H01H 77/04 337/380
5,892,426 A * 4/1999 Huang ..... H01H 73/26 337/334
5,933,069 A * 8/1999 Huang ..... H01H 73/26 200/310
5,982,269 A * 11/1999 Sorenson ..... H01H 73/26 200/553
6,072,381 A * 6/2000 Yu ..... H01H 23/003 337/112
6,121,868 A * 9/2000 Chiang ..... H01H 73/26 333/112
6,275,134 B1 * 8/2001 Chen ..... H01H 73/26 337/37
6,307,460 B1 * 10/2001 Yu ..... H01H 73/24 337/112
6,552,644 B2 * 4/2003 Yu ..... H01H 73/30 200/277.1
6,577,221 B1 * 6/2003 Wang ..... H01H 73/26 200/339
6,664,884 B1 * 12/2003 Yu ..... H01H 73/26 200/52 R
6,734,779 B2 * 5/2004 Yu ..... H01H 73/26 337/56
6,797,905 B1 * 9/2004 Wang ..... H01H 23/205 200/339
7,030,726 B2 * 4/2006 Yu ..... H01H 73/26 337/59
7,034,650 B2 * 4/2006 Yu ..... H01H 73/26 337/59
7,132,616 B1 * 11/2006 Radosavljevic ..... H01H 23/168 200/553
7,148,784 B2 * 12/2006 Yu ..... H01H 73/26 337/66
7,202,769 B2 * 4/2007 Yu ..... H01H 73/26 337/37
7,248,140 B2 * 7/2007 Yu ..... H01H 71/7436 337/56
7,292,129 B2 * 11/2007 Yu ..... H01H 73/26 337/112
7,304,560 B2 * 12/2007 Yu ..... H01H 73/26 337/56
7,307,506 B2 * 12/2007 Yu ..... H01H 73/26 337/56
7,317,375 B2 * 1/2008 Yu ..... H01H 37/20 337/56
7,345,568 B2 * 3/2008 Yu ..... H01H 37/002 337/13
7,626,482 B2 * 12/2009 Huang ..... H01H 23/24 337/59
7,656,268 B2 * 2/2010 Yu ..... H01H 73/26 200/334
7,688,174 B2 * 3/2010 Hung ..... H01H 23/025 337/56
9,165,702 B2 * 10/2015 Hagerty ..... H01C 7/126
9,698,542 B1 7/2017 I

* cited by examiner

OVERHEATING DESTRUCTIVE SWITCH

CROSS REFERENCES TO RELATED APPLICATIONS

The present application claims priority from Taiwanese Patent Application Serial Number 107134826, filed Oct. 2, 2018, the disclosure of which is hereby incorporated by reference herein in its entirety.

BACKGROUND OF THE INVENTION

(a) Field of the Invention

The present invention relates to an overheating destructive switch, and more particularly to a disconnecting switch which differs from a fuse and is different from a bimetallic strip. An overheating destructive member of the present invention does not depend on the passing of current to enforce destruction, but uses heat energy transfer to enforce destruction and cause the switch to break the circuit.

(b) Description of the Prior Art

Seesaw switches of the prior art use a control switch to effect back and forth pivot rotation within a specified angle range to control closing or opening a circuit. For example, the prior art structure of a "Spark shielding structure of switch" disclosed in ROC Patent No. 560690 describes a positioning feature when pivot rotating a switch to position the switch at a first position or a second position to form a closed circuit or an open circuit.

As for press switches of the prior art, pressing the press switch enables cycling through controlling the closing or opening of a circuit, wherein the press button uses the reciprocating press-button structure similar to that used in an automatic ball-point pen of the prior art, whereby the press button is positioned at a lower position or an upper position each time the switch press button is pressed, an example of which is described in the prior art structure of a "Push-button switch" disclosed in China Patent No. CN103441019.

In the prior art structure of an "Improved structure of an on-line switch" described in ROC Patent No. 321352, a switch structure is disclosed that is provided with a fuse; however, the fuse is positioned in the path of the power supply live wire, and thus necessarily depends on electric current passing therethrough in order to bring about a protective effect. In particular, only when the power supply is overloaded will the fuse melt and cut off the supply of power. In as much the fuse requires a current to pass through during operation; however, the current must be excessive in order to melt the fuse, hence, a low-melting-point lead-tin alloy or zinc having an electric conductivity far lower than that of copper, is often used for the fuse. Taking an extension cord socket as an example, which mainly uses copper as a conductive body, if the extension cord socket is combined with the switch disclosed in the above-described ROC Patent No. 321352 to control the power supply, then conductivity of the fuse is poor, easily resulting in power-wasting problems.

In the prior art structure of a "Bipolar type auto power off safety switch" described in ROC Patent No. M382568, a bimetallic strip type overload protection switch is disclosed; however, the bimetallic strip must similarly be positioned in the path of the electric current, and thus necessarily depends on electric current passing therethrough for deformation of the bimetallic strip to occur. More particularly, an overloaded electric current is necessary in order to cause the bimetallic strip to deform and break the circuit.

In the prior art structure of an "Overload protection switch structure for group type socket" described in ROC Patent No. M250403, an overload protection switch applied in an extension cord socket is disclosed, wherein the patented overload protection switch is fitted with a bimetallic strip. When the total power of the entire extension cord socket exceeds the rated power, the bimetallic strip undergoes heat deformation and automatically trips, thereby achieving a power-off protective effect. However, the bimetallic strip necessarily depends on electric current passing therethrough in order to bring about an overload protective effect. Moreover, electric conductivity of the bimetallic strip is far lower than that of copper, which, thus, easily results in power-wasting problems.

Nevertheless, apart from current overload causing overheating, taking an extension cord socket as an example, the following situations are all possible scenarios resulting in overheating of any one of the sockets, including:

1. Serious oxidation of the metal pins of the plug, wherein the metal pins have become coated with oxides; thus, when the plug is inserted into a socket, the oxides, having poor conductivity, cause greater electrical resistance, which results in the socket overheating.
2. When inserting the metal pins of a plug into a socket, and the metal pins are not completely inserted, resulting in only partial contact, then the contact areas are too small, which causes the socket to overheat.
3. Metal pins of the plug are deformed or worn out, resulting in incomplete contact when inserted into a socket and the contact areas being too small, which gives rise to the socket overheating.
4. Metal pins of the plug or metal strips of the socket are stained with foreign substances, such as dust or dirt, causing poor electric conductivity, which results in greater electrical resistance and overheating.

The above-described conditions result in a critical drop in the operating temperature in the locality of the socket and the operating temperature in the locality of the overload protection switch.

The inventor of the present invention in an "Assembly and method of plural conductive slots sharing an overheating destructive fixing element" described in U.S. Pat. No. 9,698,542 disclosed distance of a copper strip and temperature difference experimentation, and from the test results presented in TABLE 2 of the above patent, it can be seen that if the above-described overheated socket is positioned at test position 10 of TABLE 2, and the above-described overload protection switch is positioned at test position 1 of TABLE 2, with a distance of 9 cm between the two positions, then when the socket operating temperature reaches 202.9° C., after 25 minutes, the operating temperature of the overload protection switch is only 110.7° C.; that is, when the distance between the socket and the overload protection switch is 9 cm, and when the operating temperature of the socket has already overheated to a temperature of 202.9° C. with the possibility of accidental combustion, the bimetallic strip of the overload protection switch is still only at a temperature of 110.7° C., and has not yet reached deformation temperature; thus, the overload protection switch will not automatically trip a power-off.

Because there are many circumstances resulting in socket overheating, and the distance between the socket and the bimetallic strip of the overload protection switch can result in an enormous temperature difference, in order to effectively achieve overheating protection, an overload protection switch bimetallic strip should be installed on each of the plug sockets of the extension cord socket. However, the price of a bimetallic strip type overload protection switch is relatively high, thus installing a bimetallic strip on each of the sockets of an extension cord socket will lead to a substantial increase in cost and go against it being available to all.

SUMMARY OF THE INVENTION

Accordingly, in light of the shortcomings of current switches adopting a fuse or a bimetallic strip, the present invention provides an overheating destructive assembly for switch, comprising: an overheating destructive member and a first elastic member. The overheating destructive member comprises an awaiting destructive portion and a support portion. The awaiting destructive portion is destructed under a fail temperature condition, and the support portion is joined to the awaiting destructive portion. An axial peripheral space of the support portion defines a displacement space, the awaiting destructive portion is positioned on an outer edge of the support portion, and the awaiting destructive portion is positioned beyond the displacement space. The first elastic member butt joins to the awaiting destructive portion, and under a fail temperature condition, the first elastic member presses the awaiting destructive portion, which is thus displaced toward the displacement space.

Furthermore, the awaiting destructive portion and the support portion are formed as an integral body from the same material.

Further, the awaiting destructive portion and the support portion are made from different materials. The temperature that causes the support portion to be destructed due to overheating is defined as a support portion destructive temperature, which is relatively higher than the fail temperature.

Further, a mounting portion protrudes from the awaiting destructive portion toward the first elastic member, and is used to mount the first elastic member thereon.

The present invention is also an overheating destructive switch, which adopts the above described overheating destructive assembly for switch, and comprises: a base, a first conductive member, a second conductive member, a movable conductive member, the above-described overheating destructive member, an operating component, and a second elastic member. The base is provided with a holding space. The first conductive member as well as the second conductive member penetrate and are mounted on the base. The movable conductive member is mounted within the holding space and is electrically connected to the first conductive member, and also selectively connects with the second conductive member. The overheating destructive member is destructed under a fail temperature condition. The operating component is assembled on the base, wherein the operating component comprises an operating member and the above-described first elastic member. The operating member comprises a retaining tubular portion and a contact member, wherein the retaining tubular portion is provided with an opening. The overheating destructive member is fixedly disposed at an assembly position distance away from the opening, and the first elastic member is positioned within the retaining tubular portion. A first end of the first elastic member contacts the awaiting destructive portion of the overheating destructive member, and the contact member contacts the movable conductive member. The first elastic member is compressed and confined between the contact member and the overheating destructive member and provided with a first elastic force. A second elastic member is provided with a second elastic force that acts on the operating member. When the operating member is at a first position, the first elastic force forces the contact member to butt against the movable conductive member, causing the movable conductive member to contact the second conductive member and form a power-on state. When in a power-on state, an electric current passes through the first conductive member, the movable conductive member, and the second conductive member producing heat energy, which is transferred to the overheating destructive member through the contact member and the first elastic member. The awaiting destructive portion absorbs the heat energy and is destructed under the fail temperature condition thereof, causing the awaiting destructive portion being pressed by the first elastic member and is thus displaced toward the displacement space, resulting in lessening or loss of the first elastic force, at which time the second elastic force is larger than the first elastic force. Consequently, the second elastic force forces the operating member to displace to a second position, which causes the movable conductive member to separate from the second conductive member and form a power-off state, Furthermore, the operating member further comprises a limiting member. The limiting member is a cylinder body that defines a space, and the limiting member butts against the overheating destructive member, which causes the overheating destructive member to be fixedly disposed at the assembly position. Moreover, the first elastic member is fitted inside the space.

Further, the first elastic member is a spring, and a first end of the first elastic member is mounted on the mounting portion of the overheating destructive member.

Further, the contact member is a hollow shaped heat conducting member, and a contact end thereof contacts the movable conductive member. A second end of the first elastic member extends into the contact member.

The present invention also provides a plug socket provided with switches, wherein each of the switches comprises the overheating destructive switch as described above, a live wire insert piece, a live wire conductive member, a neutral wire conductive member, and a casing, wherein the casing comprises a live wire socket and a neutral wire socket. The live wire insert piece is electrically connected to the first conductive member. The live wire insert piece comprises a live wire slot, and each of the live wire slots correspond to the respective live wire socket. The live wire conductive member comprises live wire connecting ends. The live wire connecting ends are respectively electrically connected to the second conductive members, and the neutral wire conductive member comprises neutral wire slots, wherein each of the neutral wire slots respectively correspond to the respective neutral wire socket.

The present invention further provides an overheating destructive member assembly method for switch, comprising: a configuration of the overheating destructive member whereby the overheating destructive member is disposed inside a retaining tubular portion of the operating member. The overheating destructive member is fitted through the opening of the retaining tubular portion, which positions the overheating destructive member at a distance from the assembly position of the opening. The overheating destructive member is thus fitted at the assembly position, and is sufficient to resist gravity and avoid separating from the assembly position. The first elastic member is fitted inside the retaining tubular portion through the opening, which causes a first end of the first elastic member to contact the awaiting destructive portion of the overheating destructive member, Furthermore, the first elastic member is a spring, and a first end of the first elastic member is mounted on the mounting portion of the overheating destructive member.

Further, an embedding portion, an adhesive, or a limiting member is used to fix the overheating destructive member at the assembly position inside the retaining tubular portion.

Based on the above-described technological characteristics, the present invention is able to achieve the following effects:

1. The configuration of the overheating destructive member differs from that of a bimetallic strip or a general fuse. Moreover, its structure is simple, easily fabricated and assembled.

2. The overheating destructive member is not positioned in the path of the electric current, and is not responsible for transmitting current. Hence, when the present invention is used in an electric appliance or an extension cord socket, there will be no direct influence to the electric effectiveness of the electric appliance or the extension cord socket even though the electric conductivity of the overheating destructive member is far lower than that of copper.

3. The entire structure is simple, easily manufactured, and will not markedly increase the size of the switch. Moreover, manufacturing cost is relatively low, and is easily embodied in known seesaw switches, press switches, or other switches.

4. An embedding portion, adhesive, or a limiting member can be used to fix the overheating destructive member to the assembly position, to prevent the overheating destructive member from dropping out when inverting the operating member, and making it easy to carry out subsequent assembly procedure.

5. The awaiting destructive portion of the overheating destructive member and the support portion can be the same material, which are easily formed; however, different material can also be used. Moreover, the temperature that causes the support portion to be destructed due to overheating is relatively higher than the fail temperature of the awaiting destructive portion, and causes displacement of the awaiting destructive portion relative to the support portion when destructed.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Using the aforementioned technological characteristics, the main functions of an overheating destructive switch, an overheating destructive member, an assembly method for the overheating destructive member of the present invention, and a plug socket provided with the overheating destructive switch are clearly presented in the following embodiments.

Figure 1:
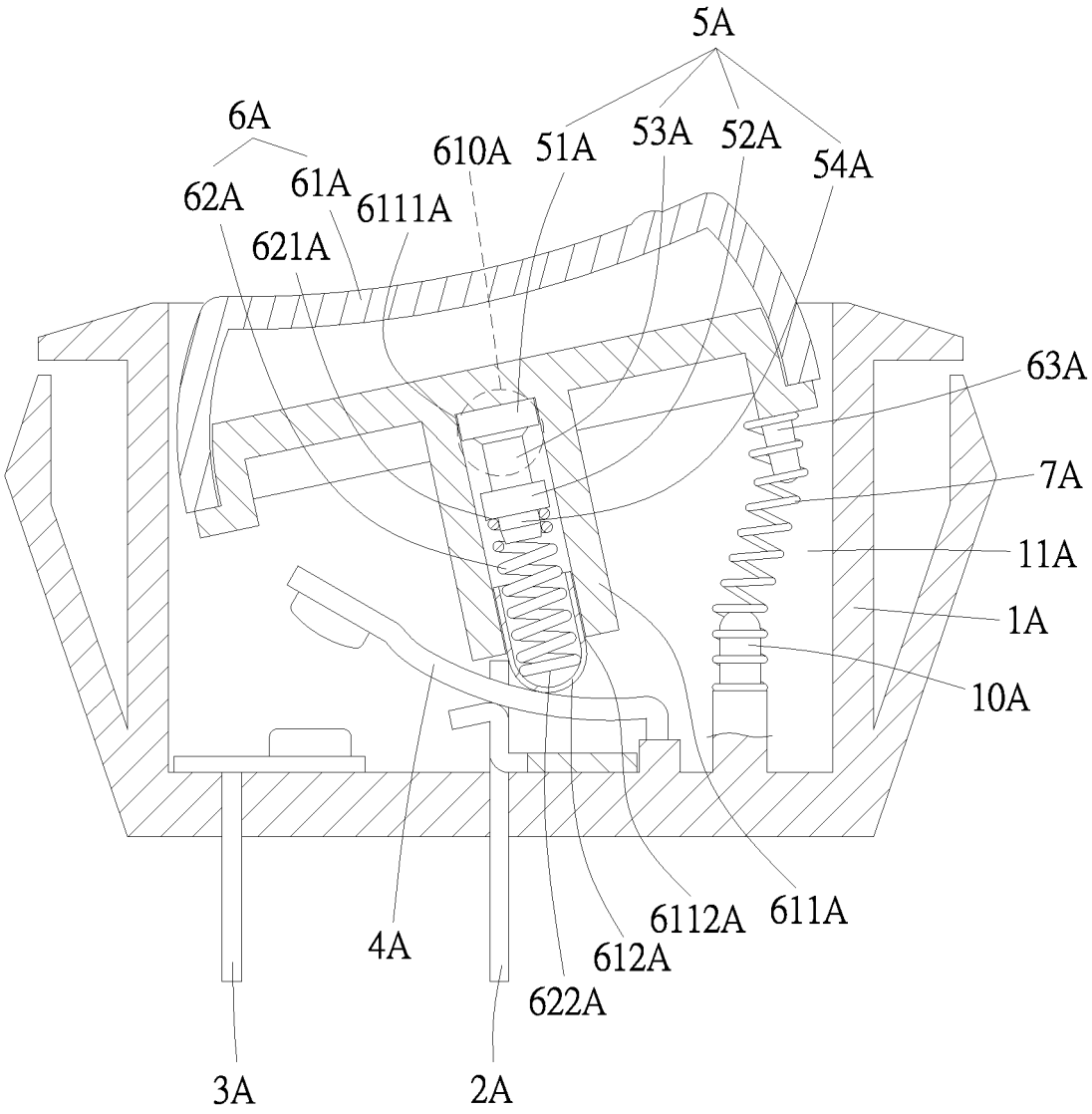
FIG. 1 is a schematic view of a first embodiment of the present invention, and shows a seesaw switch structure with the seesaw switch in a closed position.
Figure 2:
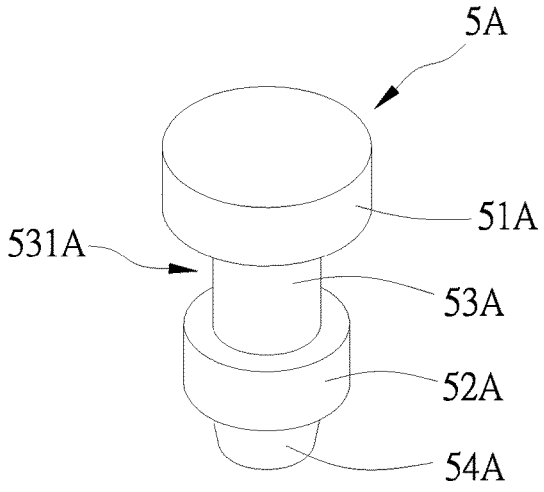
FIG. 2 is a three-dimensional external schematic view of a first embodiment of an overheating destructive member of the present invention.

Referring to FIG. 1 and FIG. 2, which show a first embodiment of the present invention, wherein an overheating destructive switch in the present embodiment is a seesaw switch, and FIG. 1 shows the seesaw switch in a closed state. The seesaw switch comprises:

A base (1A), which is provided with a holding space (11A).

A first conductive member (2A) and a second conductive member (3A), both of which penetrate and are mounted on the base (1A).

A movable conductive member, which is mounted within the holding space (11A), and the movable conductive member is a conductive seesaw member (4A). The conductive seesaw member (4A) astrides and is mounted on the first conductive member (2A) and electrically connected thereto.

When there is a temperature anomaly in the operating temperature, resulting in a rise in temperature, it is preferred that a live wire triggers a circuit break; hence, the first conductive member (2A) in use is a live wire first end, the second conductive member (3A) in use is a live wire second end, and the conductive seesaw member (4A) is used to enable electrical conduction with the first conductive member (2A) and the second conductive member (3A) to form a live wire closed circuit.

Figure 2A:
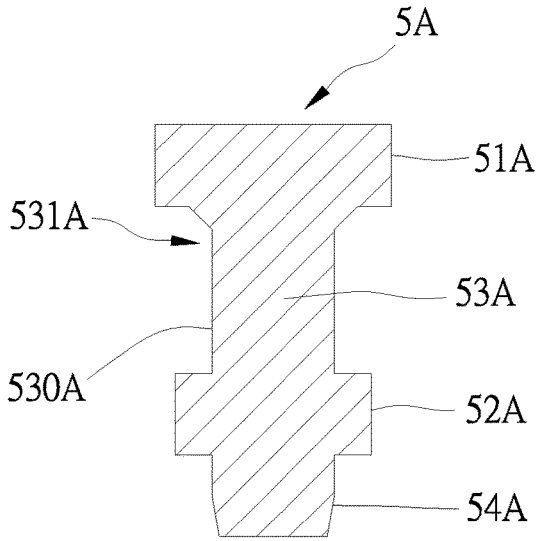
FIG. 2A is a cutaway schematic view of the first embodiment of the overheating destructive member of the present invention formed as an integral body.
Figure 2B:
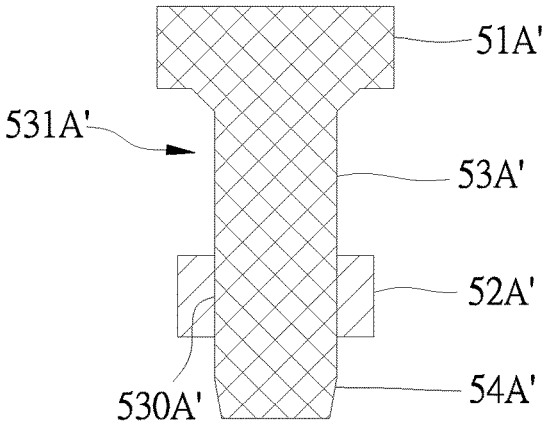
FIG. 2B is a cutaway schematic view of the first embodiment of the overheating destructive member of the present invention not formed as an integral body.

An overheating destructive member (5A), which is destructed under a fail temperature condition, the fail temperature lying between 100° C. to 250° C. The overheating destructive member (5A) is not used to maintain the continued supply of electric current; thus, insulating material such as plastic or non-insulating material made of a low-melting alloy, such as an alloy of bismuth and any one of or a composition from a plurality of the metals cadmium, indium, silver, tin, lead, antimony, or copper; or other low-melting metals or alloys with melting points lying between 100° C. to 250° C., such as a tin-bismuth alloy with a melting point around 138° C. can be used. More specifically. the overheating destructive member (5A) comprises a connecting portion (51A), an awaiting destructive portion (52A), a support portion (53A), and an axially protruding mounting portion (54A). The support portion (53A) joins the connecting portion (51A) and the awaiting destructive portion (52A). An axial peripheral space of the support portion (53A) is defined as a displacement space (531A). For instance, the diameter of the support portion (53A) is relatively smaller than that of the connecting portion (51A), thereby forming the displacement space (531A). The mounting portion (54A) is joined to the awaiting destructive portion (52A) or the support portion (53A). Referring to FIG. 2A, the awaiting destructive portion (52A) is positioned on an outer edge (530A) of the support portion (53A) (for instance, the awaiting destructive portion (52A) radially protrudes relative to the support portion (53A)). The awaiting destructive portion (52A) is positioned beyond the displacement space (531A). The connecting portion (51A), the awaiting destructive portion (52A), the support portion (53A), and the mounting portion (54A) can be formed as an integral body from the same material but is not limited by such. Referring to FIG. 2B, an awaiting destructive portion (52A') is positioned on an outer edge (530A') of a support portion (53A'). The awaiting destructive portion (52A') and the support portion (53A') can be made of different material. For instance, the connecting portion (51A'), the support portion (53A') and a mounting portion (54A') can be made of the same material, with only the awaiting destructive portion (52A') made of different material. More specifically, the temperature that causes the support portion (53A') to be destructed due to overheating is defined as a support portion destructive temperature. The support portion destructive temperature is relatively higher than the fail temperature of the awaiting destructive portion (52A'), and causes displacement of the awaiting destructive portion (52A') relative to the support portion (53A') when destructed.

Referring again to FIG. 1, the seesaw switch of the present embodiment is further provided with an operating component (6A), which is used to operate the conductive seesaw member (4A) to connect with the first conductive member (2A) and the second conductive member (3A) to form a live wire closed circuit or disconnect the circuit between the first conductive member (2A) and the second conductive member (3A), causing the live wire to form an open circuit. The operating component (6A) is assembled on the base (1A) and comprises an operating member (61A) and a first elastic member (62A). The operating member (61A) is provided with a pivot connecting point (610A) that is pivot connected to the base (1A), thereby enabling the operating member (61A) to use the pivot connecting point (610A) as an axis and limit back and forth rotation. The operating member (61A) further comprises a retaining tubular portion (611A) and a contact member (612A). The end of the retaining tubular portion (611A) at a distance away from the conductive seesaw member (4A) is provided with an assembly position (6111A), which can be a groove face. The end of the retaining tubular portion (611A) is provided with an opening (6112A) at a distance adjacent to the conductive seesaw member (4A). The overheating destructive member (5A) is fitted into the retaining tubular portion (611A) through the opening (6112A), which causes the overheating destructive member (5A) to be positioned at the assembly position (6111A), and also fixes the connecting portion (51A) of the overheating destructive member (5A) at the assembly position (6111A). Because the first elastic member (62A) is enclosed inside the retaining tubular portion (611A) through the opening (6112A), thus, a first end (621A) of the first elastic member (62A) is caused to contact the awaiting destructive portion (52A). The contact member (612A) is also installed in the retaining tubular portion (611A) through the opening (6112A). The contact member (612A) contacts the conductive seesaw member (4A) and further contacts a second end (622A) of the first elastic member (62A). For instance, the contact member (612A) is a heat conducting member that is mounted on the second end (622A). The first elastic member (62A) is compressed and confined between the contact member (612A) and the overheating destructive member (5A) and provided with a first elastic force.

The seesaw switch of the present embodiment is further provided with a second elastic member (7A), which, in the present embodiment, is a spring. The second elastic member (7A) is provided with a second elastic force that acts on the operating member (61A). For instance, the operating member (61A) is provided with a first protruding portion (63A) at a position away to one side of the pivot connecting point (610A), and the base (1A) is provided with a second protruding portion (10A) at a position corresponding to the first protruding portion (63A). The two ends of the second elastic member (7A) are respectively mounted on the first protruding portion (63A) and the second protruding portion (10A).

Figure 3:
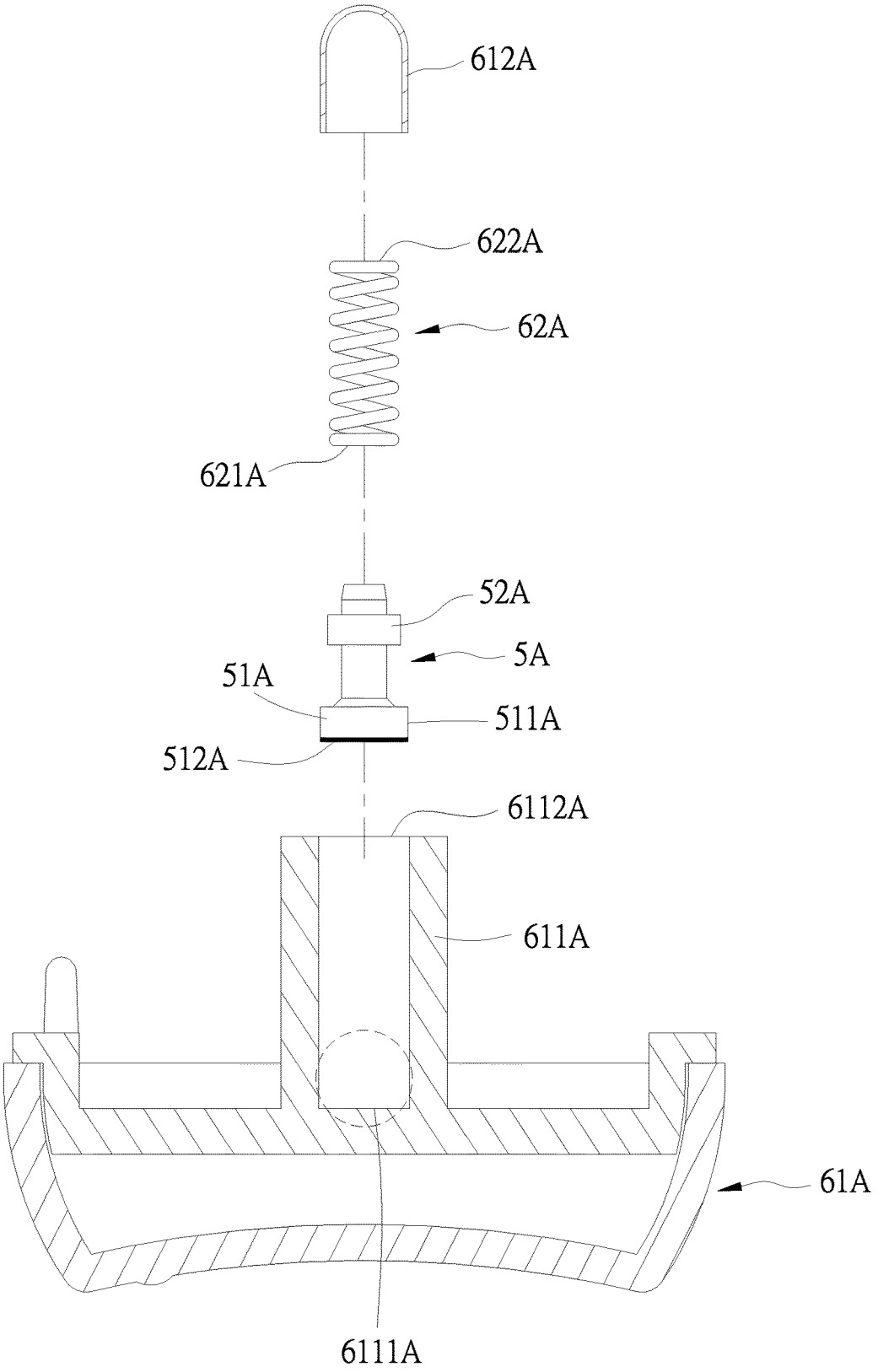
FIG. 3 is an exploded schematic view of the overheating destructive member, an operating member, and a first elastic member of the first embodiment of the present invention.

Referring to FIG. 3 together with FIG. 1, the following provides a further detailed description of the assembly method for the overheating destructive member (5A).

The disposition of the above-described overheating destructive member (5A) is a configuration whereby the overheating destructive member (5A) is disposed inside the above-described retaining tubular portion (611A) of the operating member (61A).

The overheating destructive member (5A) is fitted through the opening (6112A) of the retaining tubular portion (611A), which causes the overheating destructive member (5A) to be positioned at a distance away from the assembly position (6111A) of the opening (6112A), and fixes the overheating destructive member (5A) at the assembly position (6111A), thereby sufficiently resisting gravity to avoid separating from the assembly position (6111A). For instance, the connecting portion (51A) uses an embedding portion (511A) (using fixing methods such as a tight fitting portion between the connecting portion (51A) and the retaining tubular portion (611A) or matching concave-convex embedding portions) or/and an adhesive (512A) (such as substances having adhesion properties, including an adhesive, grease, and the like) to effect fixing in the retaining tubular portion (611A), and causing the overheating destructive member (5A) to be positioned at the assembly position (6111A).

The above-described first elastic member (62A) is fitted inside the retaining tubular portion (611A) through the opening (6112A), which causes the first end (621A) of the first elastic member (62A) to contact the awaiting destructive portion (52A) of the overheating destructive member (5A). Accordingly, the initial assembly of the overheating destructive member (5A) is completed, which prevents the overheating destructive member from dropping out after inversion of the operating member (61A) thereof, and enables easy subsequent assembly procedure of the entire switch to be carried out. In the present embodiment, the first elastic member (62A) is a spring, and the first end (621A) of the first elastic member (62A) is mounted on the mounting portion (54A) of the overheating destructive member (5A).

The contact member (612A) is assembled in the retaining tubular portion (611A) through the opening (6112A), which causes the contact member (612A) to contact the second end (622A) of the first elastic member (62A). Moreover, the assembly sequence of the above-described assembly method is not restricted to the above described sequence. For instance, the overheating destructive member (5A) can be first assembled to the above-described first elastic member (62A) or first assemble the first elastic member (62A) to the contact member (612A). The primary objective of the assembly lies in fixing the assembly position (6111A) by means of the overheating destructive member (5A), and preventing the overheating destructive member (5A) from dropping out when inverting the operating member (61A).

Figure 4:
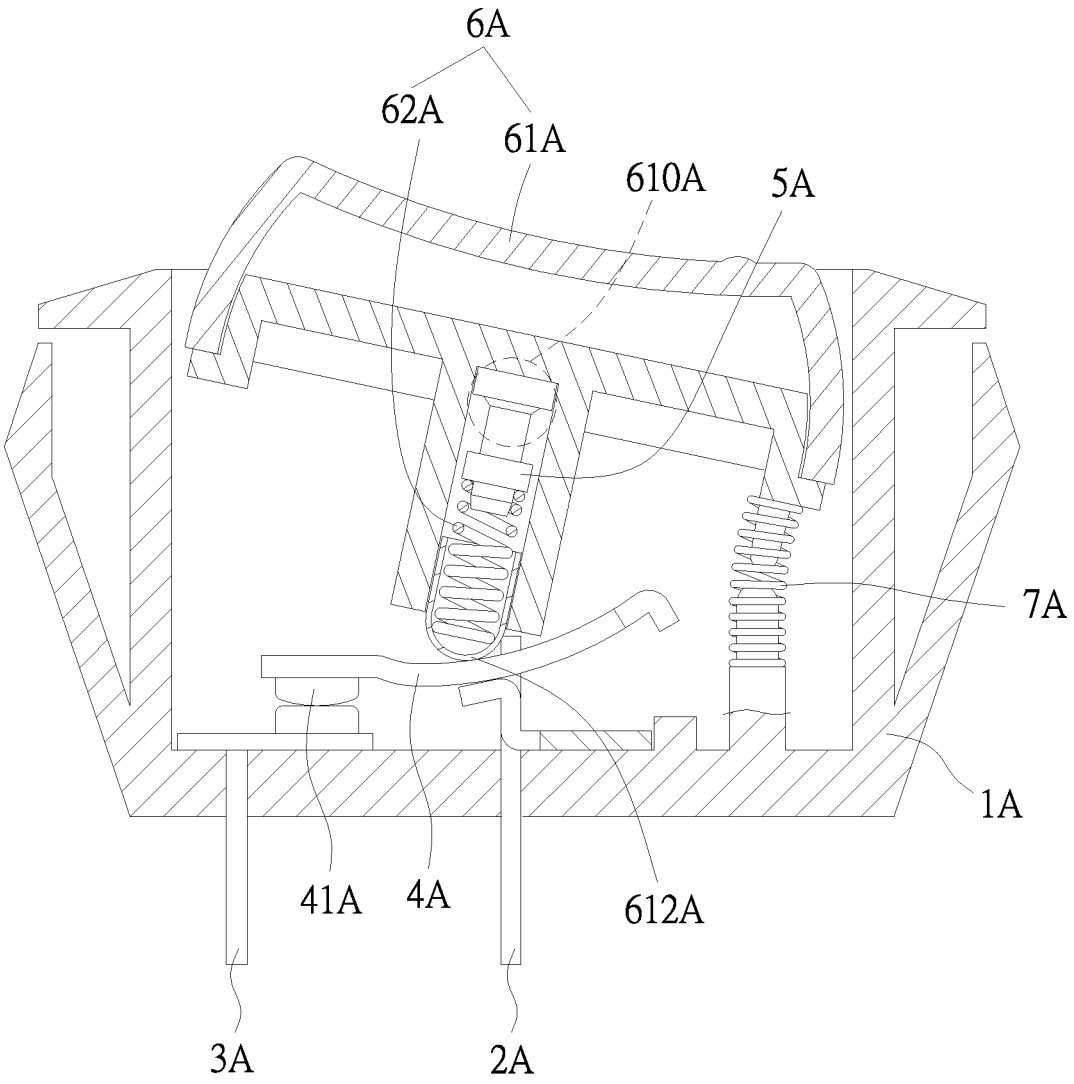
FIG. 4 is a schematic view of the first embodiment of the present invention, and shows the seesaw switch in an open position.

Referring to FIG. 4, a user toggles the operating member (61A) back and forth around the pivot connecting point (610A), which causes the contact member (612A) to slide on the conductive seesaw member (4A), enabling the conductive seesaw member (4A) to selectively contact or separate from the second conductive member (3A) in a seesaw movement. When the contact member (612A) is slid on the conductive seesaw member (4A) in the direction of a silver contact point (41A) on the conductive seesaw member (4A), the first elastic force forces the silver contact point (41A) to contact the second conductive member (3A) and form a power-on state.

Figure 5:
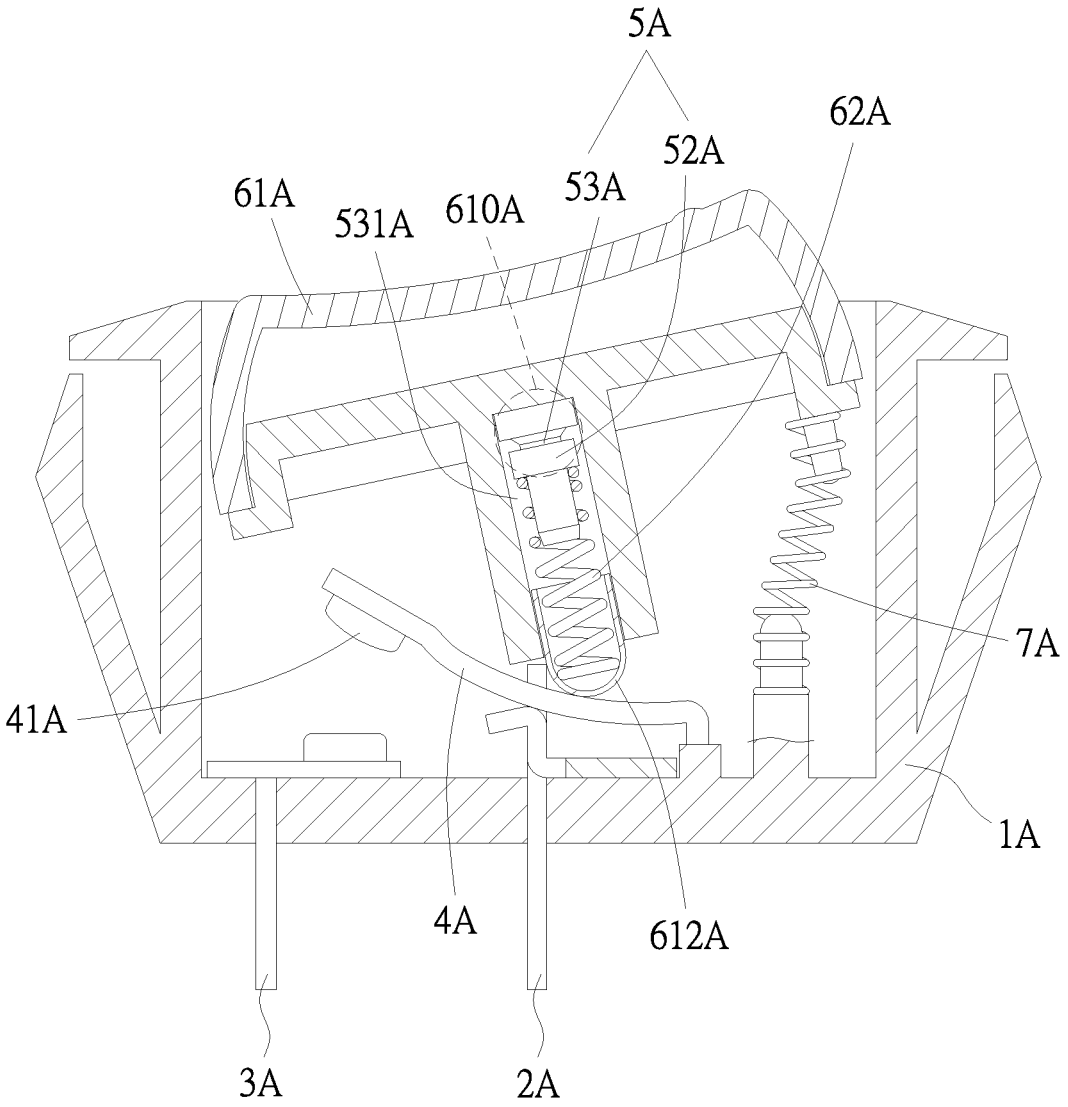
FIG. 5 is schematic view of the first embodiment of the present invention, and shows, when the overheating destructive member is destructed due to overheating, a movable conductive member disconnected from a second conductive member, causing the seesaw switch to revert to a closed position from an open position and forming an open circuit.

Referring to FIG. 5, when an abnormal condition occurs in an external electric equipment connected to the first conductive member (2A) or the second conductive member (3A), for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, whereupon, the heat energy is transferred to the conductive seesaw member (4A) through the first conductive member (2A) or the second conductive member (3A). Finally, the heat energy is transferred to the overheating destructive member (5A) through the contact member (612A) and the first elastic member (62A). The awaiting destructive portion (52A) of the overheating destructive member (5A) absorbs the heat energy up to the material melting point thereof, at which time the awaiting destructive portion (52A) of the overheating destructive member (5A) begins to gradually lose its rigidity, which causes the rigidity of the awaiting destructive portion (52A) to be relatively smaller than that of the support portion (53A). For instance, if the material of the overheating destructive member (5A) is a tin-bismuth alloy, although the melting point thereof is 138° C., the tin-bismuth alloy begins to lose its rigidity when the temperature is close to its melting point, and under the concurrent effect of the first elastic force, the awaiting destructive portion (52A) of the overheating destructive member (5A) is pressed by the first elastic member (62A) and gradually displaced toward the displacement space (531A), resulting in lessening or loss of the first elastic force, at which time the second elastic force is larger than the first elastic force. In the present embodiment, the arrangement of the first conductive member (2A) and the second conductive member (3A) is defined as being in a lengthwise direction. The operating member (61A) has a length in the lengthwise direction, and the first elastic member (62A) is disposed at the central position of the length. In addition, there is a distance between the disposed position of the second elastic member (7A) on the length and the central position. Hence, when the second elastic force is larger than the first elastic force, a torque effect enables the operating member (61A) to rotate on the pivot connecting point (610A) as an axis, thereby driving the contact member (612A) to slide on the conductive seesaw member (4A), which forces the operating member (61A) to displace and form a closed position. Accordingly, the silver contact point (41A) of the conductive seesaw member (4A) separates from the second conductive member (3A) to form a power-off state, thereby achieving the protective effect against overheating.

Figure 6:
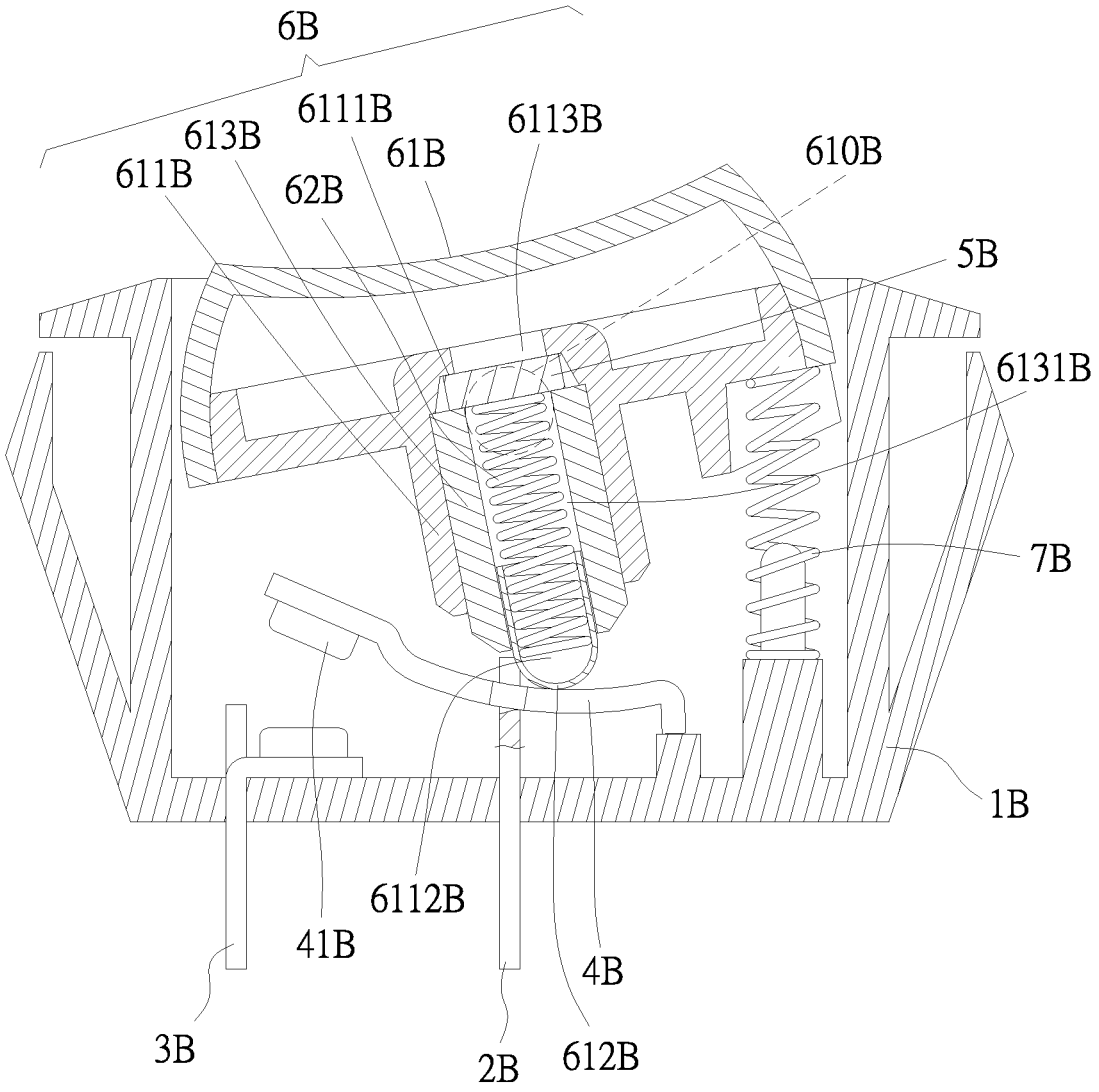
FIG. 6 is a schematic view of a second embodiment of the present invention, and shows a seesaw switch structure with the seesaw switch in a closed position.
Figure 7:
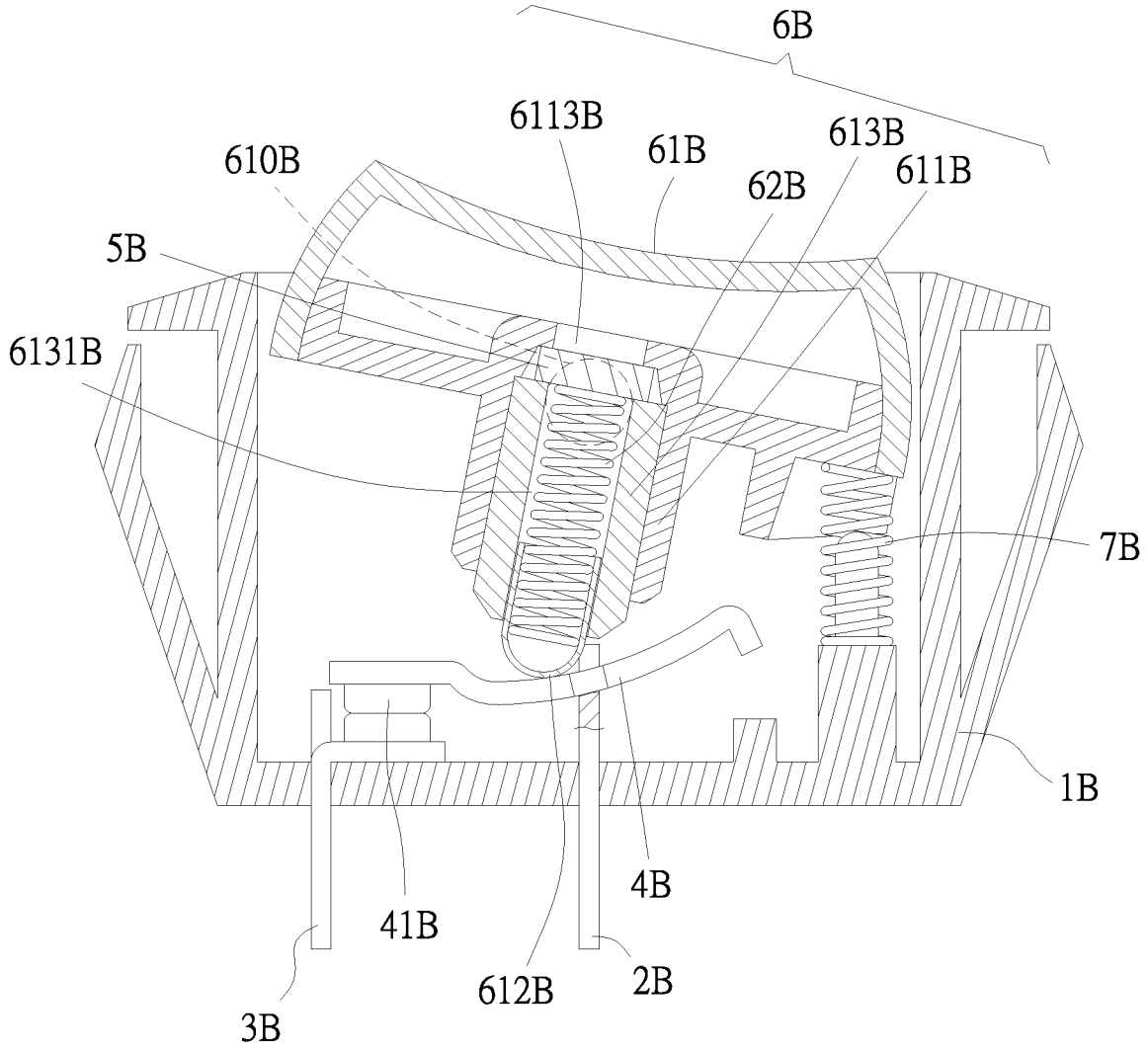
FIG. 7 is a schematic view of the second embodiment of the present invention, and shows the seesaw switch in an open position.

Referring to FIG. 6 and FIG. 7, which show a second embodiment of the present invention, wherein the present embodiment is an overheating destructive switch, which, in the present embodiment, is a seesaw switch, and FIG. 6 depicts the seesaw switch in a closed state. The seesaw switch is almost the same as the first embodiment, with the overheating destructive switch comprising a base (1B), a first conductive member (2B), a second conductive member (3B), a movable conductive member, an overheating destructive member (5B), an operating component (6B), and a second elastic member (7B); wherein the movable conductive member is a conductive seesaw member (4B), which astrides and is mounted on the first conductive member (2B) and electrically connected to the first conductive member (2B). The operating member (61B) uses a pivot connecting point (610B) as an axis and limits back and forth rotation, which enables the contact member (612B) to slide on the conductive seesaw member (4B), enabling the conductive seesaw member (4B) to selectively contact or separate from the second conductive member (3B) in a seesaw movement. When the contact member (612B) is slid on the conductive seesaw member (4B) in the direction of a silver contact point (41B) on the conductive seesaw member (4B), the first elastic force forces the silver contact point (41B) to contact the second conductive member (3B) and form a power-on state. The second elastic member (7B), in the present embodiment, is a spring, and is provided with a second elastic force that acts on the operating member (61B).

The primary difference from the first embodiment lies in the operating member (61B) which further comprising a limiting member (613B), which is a cylinder body that defines a space (6131B). The limiting member is used to butt against the overheating destructive member (5B), which, as described above, is similarly caused to be positioned at an assembly position (6111B) of a retaining tubular portion (611B), and is also not limited to using an adhesive or embedding portion as described in the first embodiment. The first elastic member (62B) is fitted inside the space (6131B), In addition. The retaining tubular portion (611B) is further provided with a through hole (6113B). The through hole (6113B) corresponds to an opening (6112B) of the retaining tubular portion (611B), and the diameter of the through hole (6113B) is larger than the width of the first elastic member (62B).

Figure 8:
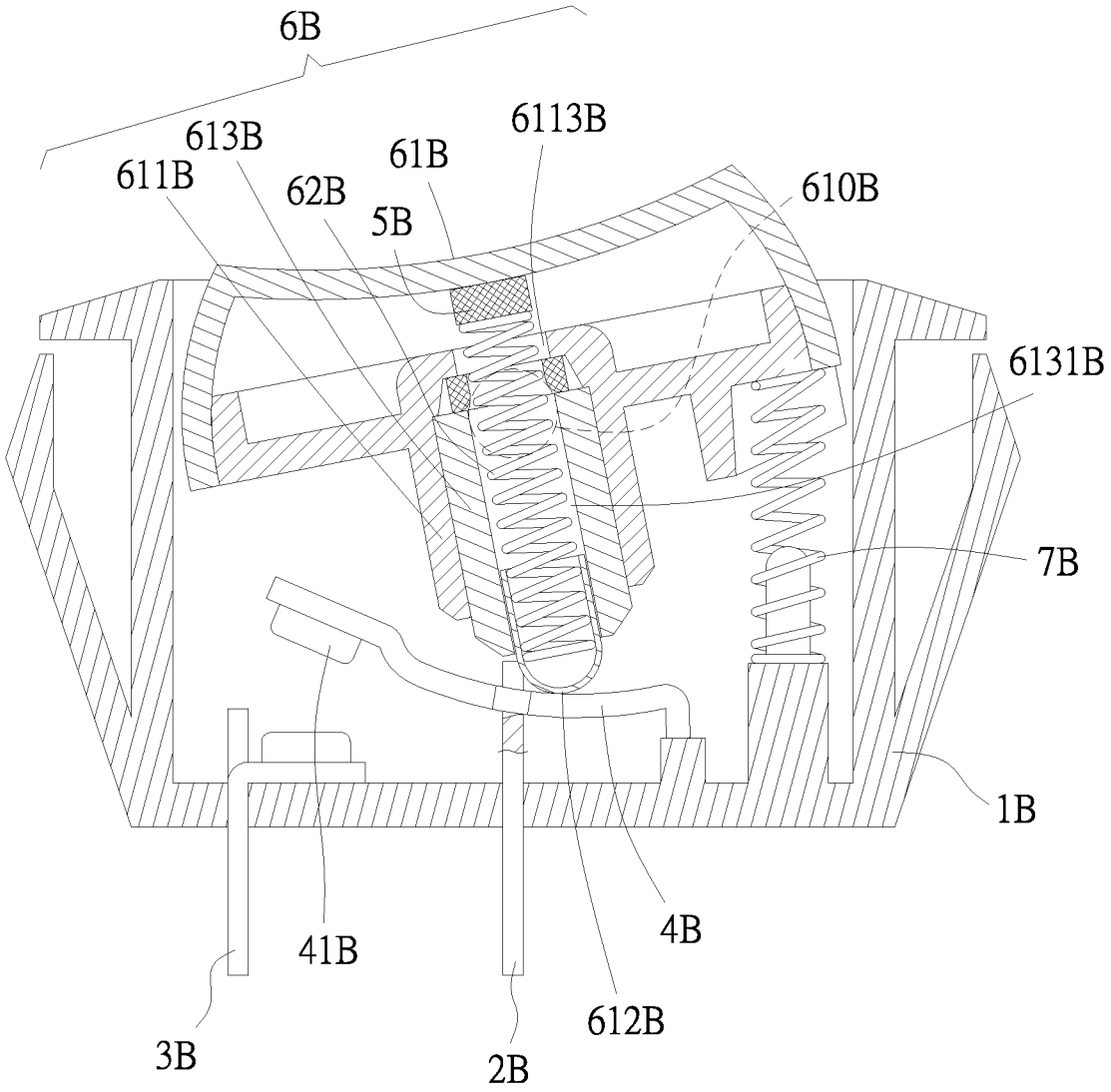
FIG. 8 is a schematic view of the second embodiment of the present invention, and shows, when an overheating destructive member is destructed due to overheating, a movable conductive member disconnected from a second conductive member, causing the seesaw switch to revert to a closed position from an open position and forming an open circuit.

Referring to FIG. 8, when an abnormal condition occurs in an external electric equipment connected to the first conductive member (2B) or the second conductive member (3B), for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, whereupon, the heat energy is transferred to the conductive seesaw member (4B) through the first conductive member (2B) or the second conductive member (3B), and then transferred to the overheating destructive member (5B) through the contact member (612B) and the first elastic member (62B). The overheating destructive member (5B) gradually absorbs the heat energy up to the material melting point thereof, at which time the overheating destructive member (5B) begins to gradually lose its rigidity. For instance, if the material of the overheating destructive member (5B) is a tin-bismuth alloy, although the melting point thereof is 138° C., the tin-bismuth alloy begins to lose its rigidity when the temperature is close to its melting point, and under the concurrent effect of the first elastic force, the overheating destructive member (5B) is pressed and deformed by the first elastic member (62B) to the extent of being destructed, which causes the first elastic member (62B) to penetrate the overheating destructive member (5B) and protrude through the through hole (6113B), resulting in lessening or loss of the first elastic force, consequently, the second elastic force is larger than the first elastic force. A torque effect then forces the operating member (61B) to rotate on the pivot connecting point (610B) as an axis, thereby driving the contact member (612B) to slide on the conductive seesaw member (4B), which forces the operating member (61B) to displace and form a closed position. Accordingly, the silver contact point (41B) of the conductive seesaw member (4B) separates from the second conductive member (3B) to form a power-off state, thereby achieving the protective effect against overheating.

Figure 9:
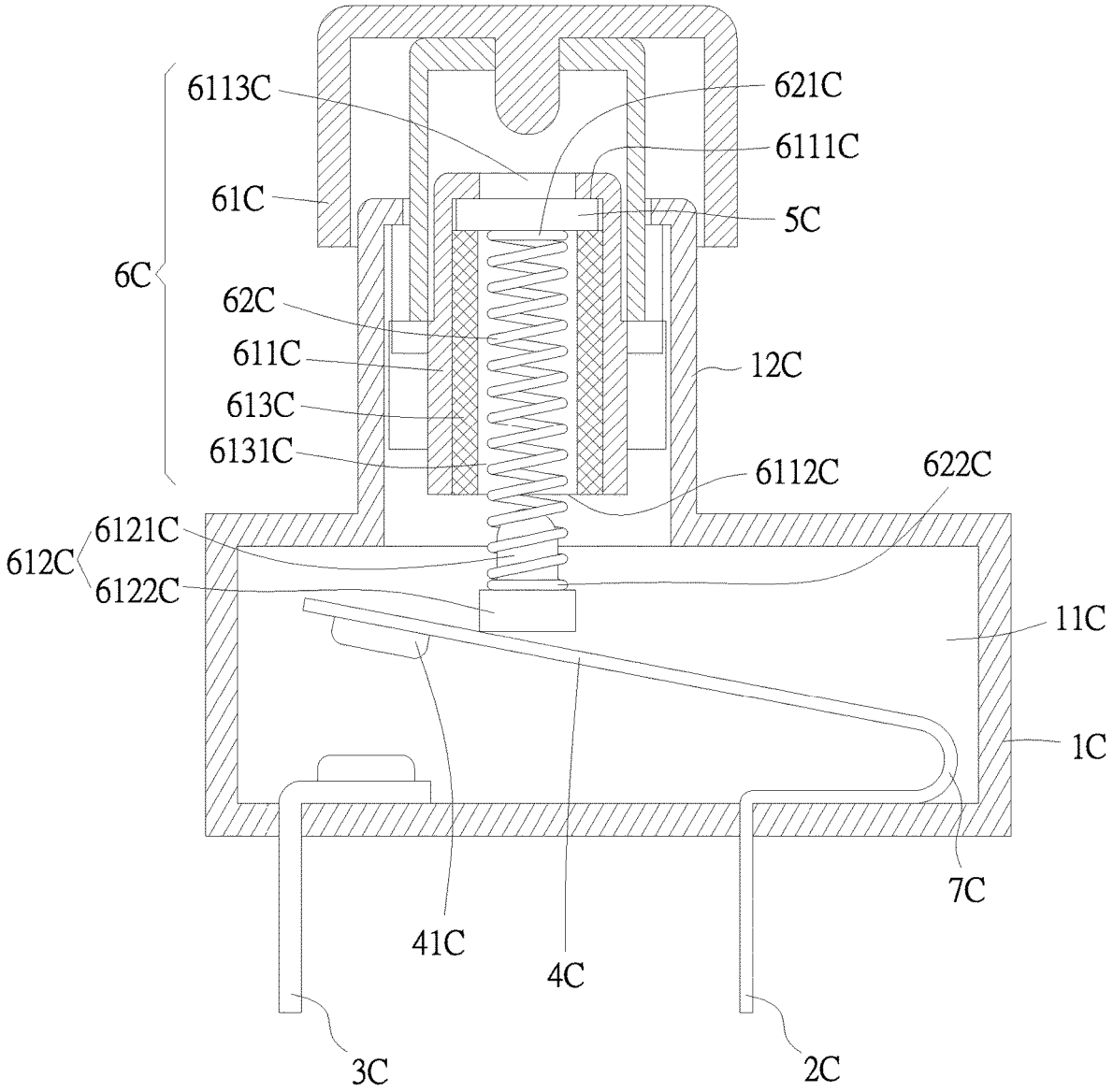
FIG. 9 is a schematic view of a third embodiment of the present invention, and shows a press switch structure with the press switch in a closed position.
Figure 10:
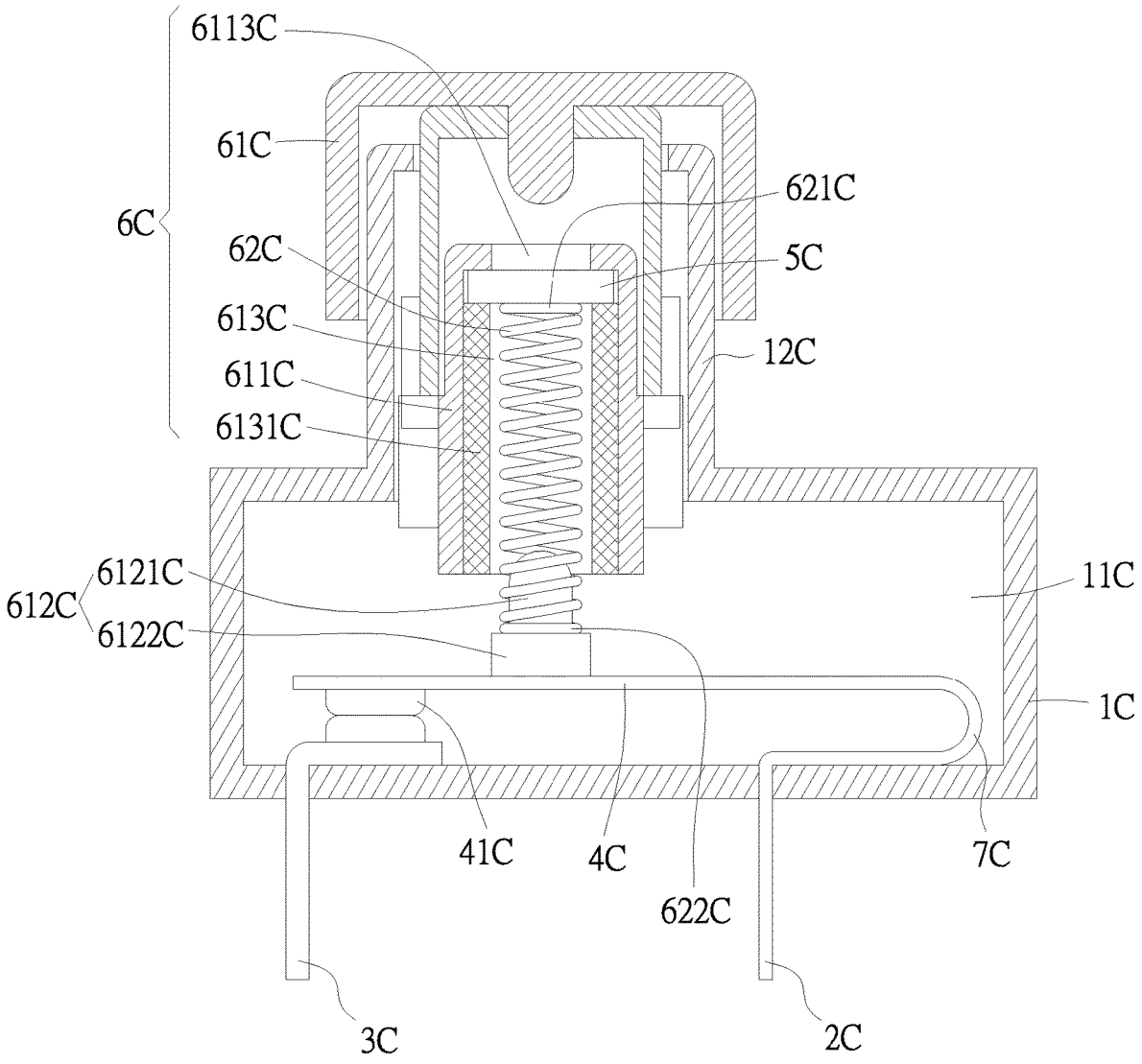
FIG. 10 is a schematic view of the third embodiment of the present invention, and shows the press switch in an open position.

Referring to FIG. 9 and FIG. 10, which show a third embodiment of the present invention, wherein the present embodiment is an overheating destructive switch, which in the present embodiment is a press switch, and FIG. 9 shows the press switch in a closed state. The press switch comprises:

A base (1C), which is provided with a holding space (11C) and a protruding portion (12C).

A first conductive member (2C) and a second conductive member (3C), both of which penetrate and are mounted on the base (1C).

A movable conductive member, which is mounted within the holding space (11C), and the movable conductive member is a conductive cantilever member (4C).

An overheating destructive member (5C), which is destructed under a fail temperature condition, the fail temperature lying between 100° C. to 250° C. The overheating destructive member (5C) is not used to maintain the continued supply of electric current, thus, insulating material such as plastic or non-insulating material made of a low-melting alloy, such as an alloy of bismuth and any one of or a composition from a plurality of the metals cadmium, indium, silver, tin, lead, antimony, or copper, or other low-melting metals or alloys with melting points lying between 100° C. to 250° C., such as a tin-bismuth alloy with a melting point around 138° C. can be used. In the present embodiment, the overheating destructive member (5C) is a circular disk, however, other shapes such as a rod body, a cap, a radial shaped body, a block, a spherical body, or an irregular shaped body are also suitable embodiments.

When there is a temperature anomaly in the operating temperature, resulting in a rise in temperature, it is preferred that a live wire triggers a circuit break; hence, the first conductive member (2C) in use is a live wire first end, the second conductive member (3C) in use is a live wire second end, and the conductive cantilever member (4C) is used to enable electrical conduction with the first conductive member (2C) and the second conductive member (3C) to form a live wire closed circuit.

The press switch of the present embodiment is further provided with an operating component (6C), which is used to operate the conductive cantilever member (4C) to connect with the first conductive member (2C) and the second conductive member (3C) to form a live wire closed circuit or disconnect the circuit between the first conductive member (2C) and the second conductive member (3C), causing the live wire to form an open circuit. The operating component (6C) is assembled on the base (1C), and comprises an operating member (61C) and a first elastic member (62C). The operating member (61C) is mounted on the protruding portion (12C), thus providing the operating member (61C) with limited up and down displacement on the protruding portion (12C). The up and down displacement and positioning structure of the entire operating component (6C) is the same as the press button structure of an automatic ball-point pen of the prior art, such as the prior art structure of a "Push-button Switch" disclosed in China Patent No. CN103441019; therefore, the drawings of the present embodiment omit illustrating a number of structural positions disclosed in the prior art. The operating member (61C) further comprises a retaining tubular portion (611C), a contact member (612C), and a limiting member (613C). The end of the retaining tubular portion (611C) is provided with an assembly position (6111C) at a distance away from the conductive cantilever member (4C), wherein the assembly position (6111C) can be a groove face. The end of the retaining tubular portion (611C) is provided with an opening (6112C) adjacent to the conductive cantilever member (4C). The end of the retaining tubular portion (611C) is also provided with a through hole (6113C) at a distance from the conductive cantilever member (4C). The overheating destructive member (5C) is fitted in the retaining tubular portion (611C) through the opening (6112C), thereby positioning the overheating destructive member (5C) at the assembly position (6111C). The limiting member (613C) is a cylinder body that defines a space (6131C). The limiting member is used to butt against the overheating destructive member (5C), which is thus positioned at the assembly position (6111C) of the retaining tubular portion (611C), and is sufficient to resist gravity and avoid separating from the assembly position (6111C). A first end (621C) of the first elastic member (62C) butts against the overheating destructive member (5C). The contact member (612C) comprises a limiting post (6121C) and a supporting base (6122C). The limiting post (6121C) extends into a second end (622C) of the first elastic member (62C), causing the first elastic member (62C) to butt against the supporting base (6122C). The supporting base (6122C) also contacts the conductive cantilever member (4C), and the overheating destructive member (5C) butts against the limiting member (613C). The first elastic member (62C) is compressed and confined between the contact member (612C) and the overheating destructive member (5C) and provided with a first elastic force.

The press switch of the present embodiment is further provided with a second elastic member, which is a spring plate (7C). The first conductive member (2C), the spring plate (7C), and the conductive cantilever member (4C) are formed as an integral body. The spring plate (7C) is provided with a second elastic force, which acts on the operating member (61C).

A user displaces the operating member (61C) relative to the protruding portion (12C), just like pressing the button on an automatic ball-point pen, which causes the conductive cantilever member (4C) to selectively contact or separate from the second conductive member (3C). When the operating member (61C) is displaced in the direction of the conductive cantilever member (4C) and positioned, the supporting base (6122C) of the contact member (612C) presses down on the position of a silver contact point (41C) of the conductive cantilever member (4C), which causes the conductive cantilever member (4C) to contact the second conductive member (3C) and form a power-on state, at the same time the first elastic member (62C) is further compressed, enlarging the first elastic force, as a result the first elastic force is larger than the second elastic force.

Figure 11:
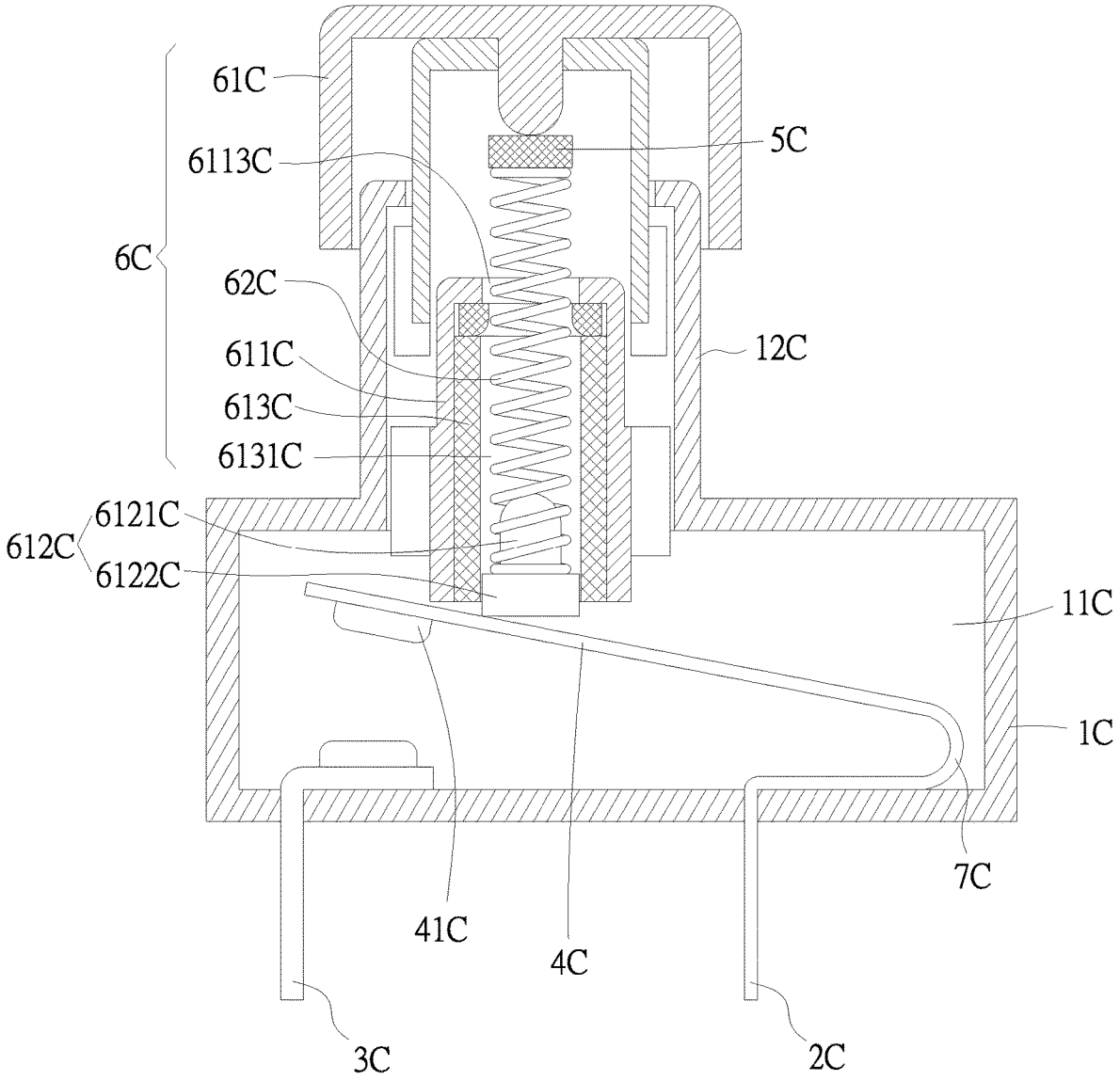
FIG. 11 is a schematic view of the third embodiment of the present invention, and shows, when an overheating destructive member is destructed due to overheating, a movable conductive member disconnected from a second conductive member and forming an open circuit.

Referring to FIG. 11, when an abnormal condition occurs in an external electric equipment connected to the first conductive member (2C) or the second conductive member (3C), for example, the external electric equipment is a plug socket, oxides or dust present between the metal pins of a plug and the plug socket, or incomplete insertion or distortion of the metal pins will produce relatively large amounts of heat energy in the electrical conducting portions of the plug socket, whereupon, the heat energy is transferred to the conductive cantilever member (4C) through the first conductive member (2C) or the second conductive member (3C), and then through the supporting base (6122C) and the limiting post (6121C) of the contact member (612C). The first elastic member (62C) then transfers the heat to the overheating destructive member (5C), whereupon the overheating destructive member (5C) gradually absorbs the heat energy up to the material melting point thereof, at which time the overheating destructive member (5C) begins to gradually lose its rigidity. For instance, if the material of the overheating destructive member (5C) is a tin-bismuth alloy, although the melting point thereof is 138° C., the tin-bismuth alloy begins to lose its rigidity when the temperature is close to its melting point, and under the concurrent effect of the first elastic force, the overheating destructive member (5C) is pressed and deformed by the first elastic member (62C) to the extent of being destructed. The overheating destructive member (5C) is thus no longer able to restrain the first elastic member (62C), causing the first elastic member (62C) to penetrate the overheating destructive member (5C) and protrude through the through hole (6113C), resulting in lessening or loss of the first elastic force. Consequently, the second elastic force is larger than the first elastic force, thus forcing the conductive cantilever member (4C) to reposition, and causing the silver contact point (41C) of the conductive cantilever member (4C) to separate from the second conductive member (3C) to form a power-off state, thereby achieving the protective effect against overheating.

Figure 12:
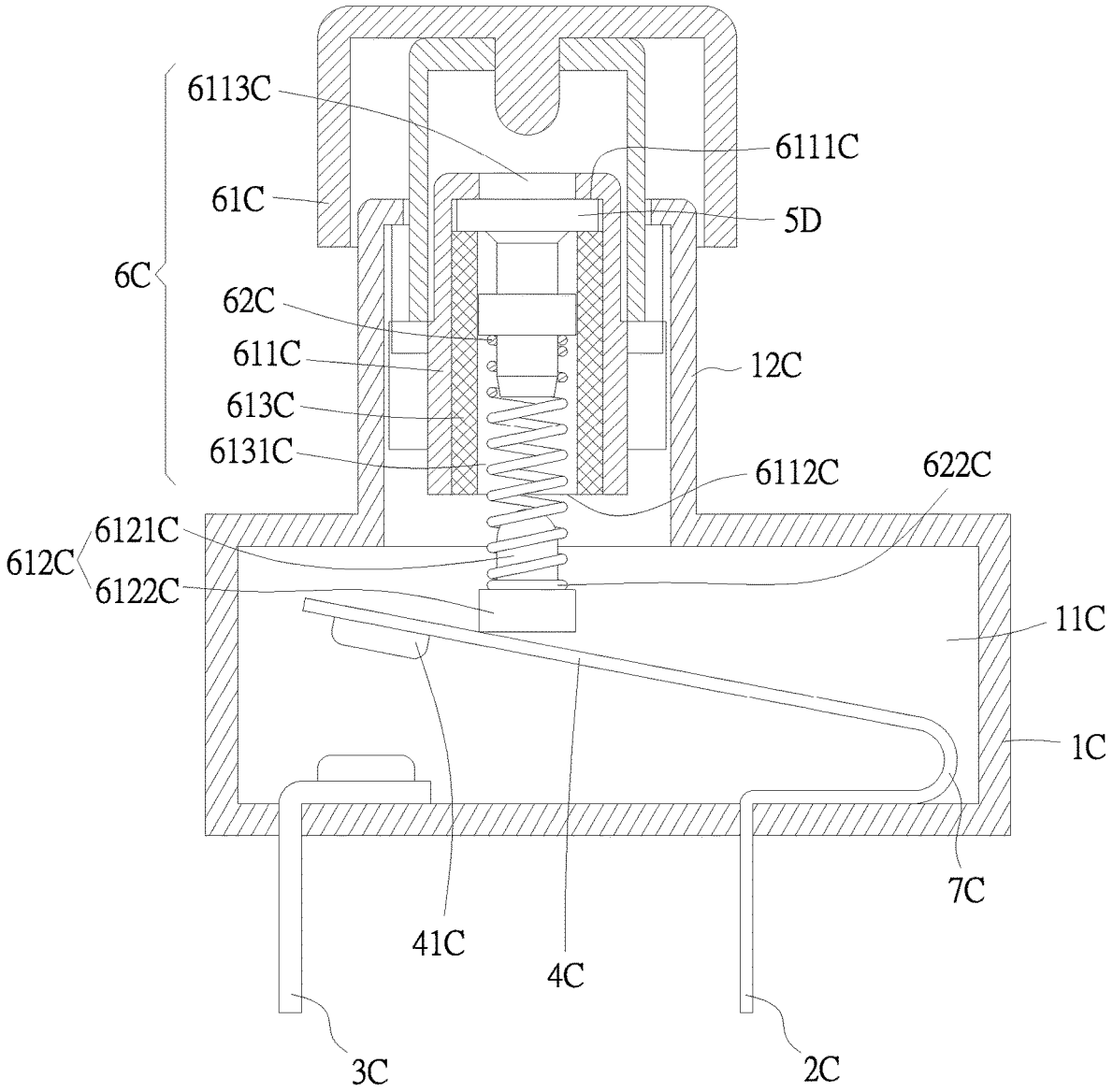
FIG. 12 is a schematic view of a fourth embodiment of the present invention, and shows a press switch structure with the press switch in a closed position.
Figure 13:
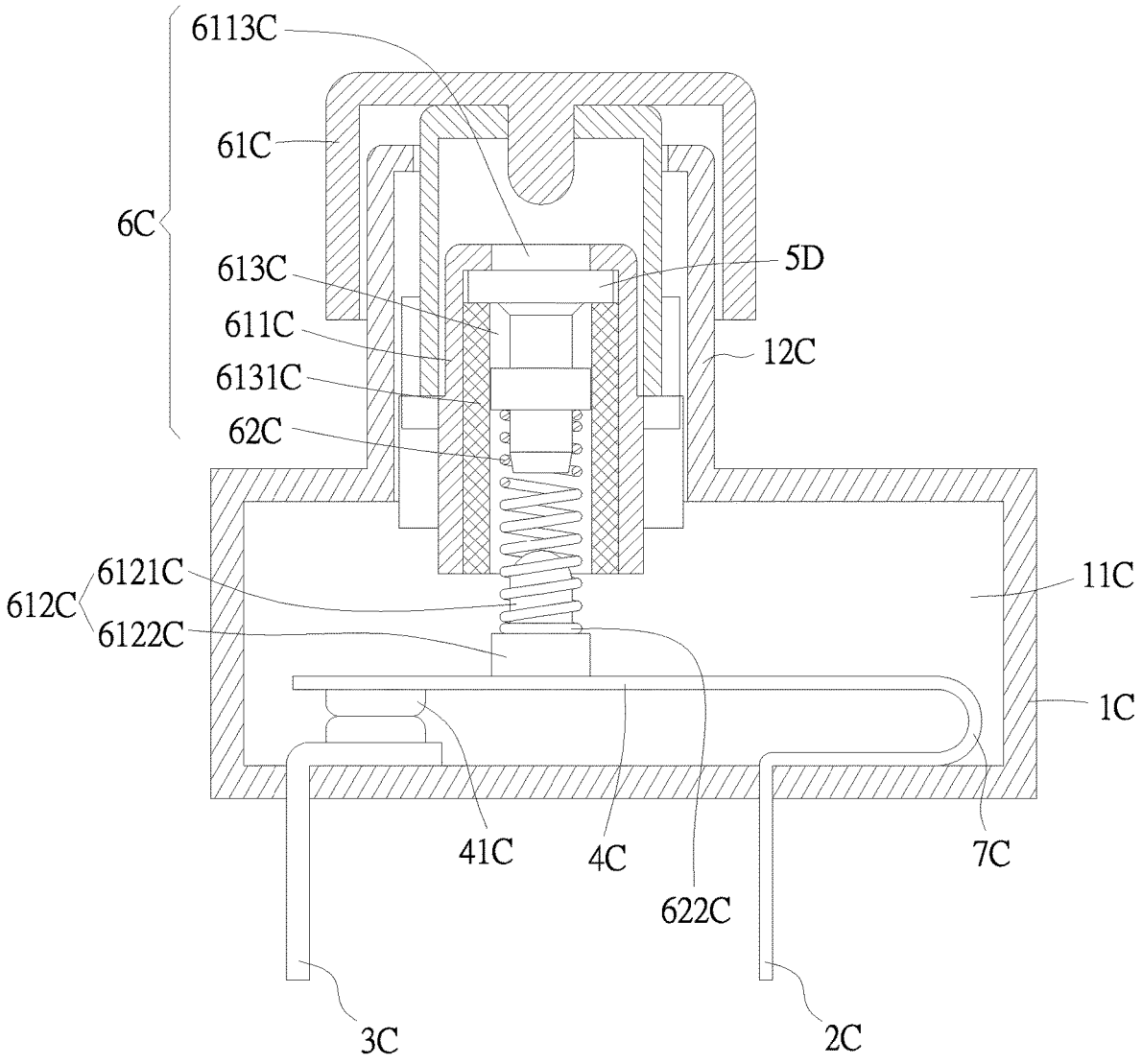
FIG. 13 is a schematic view of the fourth embodiment of the present invention, and shows the press switch in an open position.
Figure 14:
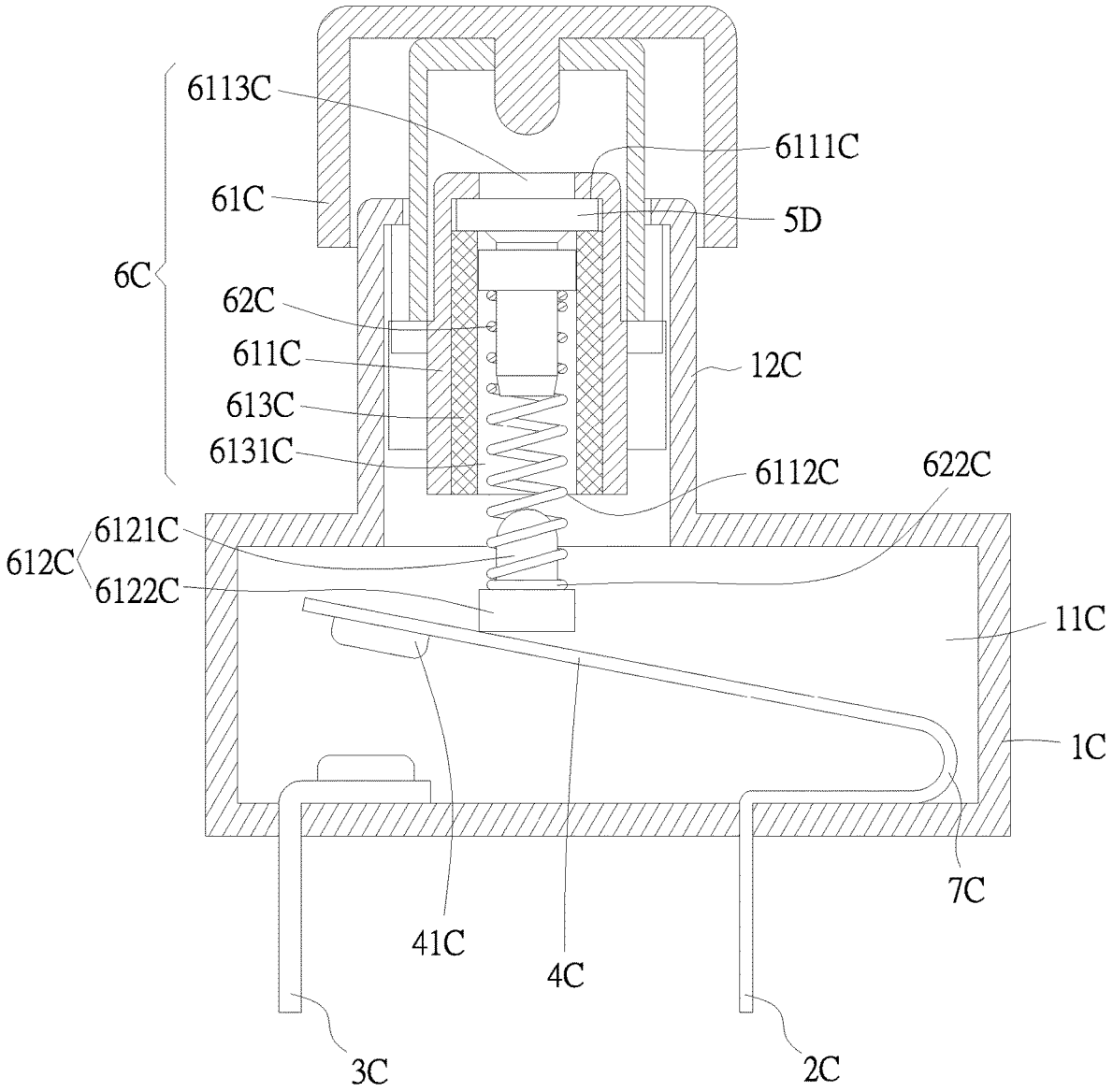
FIG. 14 is a schematic view of the fourth embodiment of the present invention, and shows, when an overheating destructive member is destructed due to overheating, a movable conductive member disconnected from a second conductive member and forming an open circuit.

Referring to FIG. 12 in comparison to FIG. 9 and FIG. 2, it is important to add that the form of the above-described overheating destructive member (5C) is not limited to a circular shaped body. In a fourth embodiment shown in FIG. 12, the overheating destructive member (5D) adopted is the same as the form of the overheating destructive member (5A) of the first embodiment, the only difference between both the above-identified embodiments is the dimensional proportions. Accordingly, it can be seen that FIG. 13 shows a power-on state and that FIG. 14 shows the overheating destructive member (5D) destructed and has formed a power-off state. Because the actuation principle is almost the same as the third embodiment, thus not further detailed herein.

Figure 15:
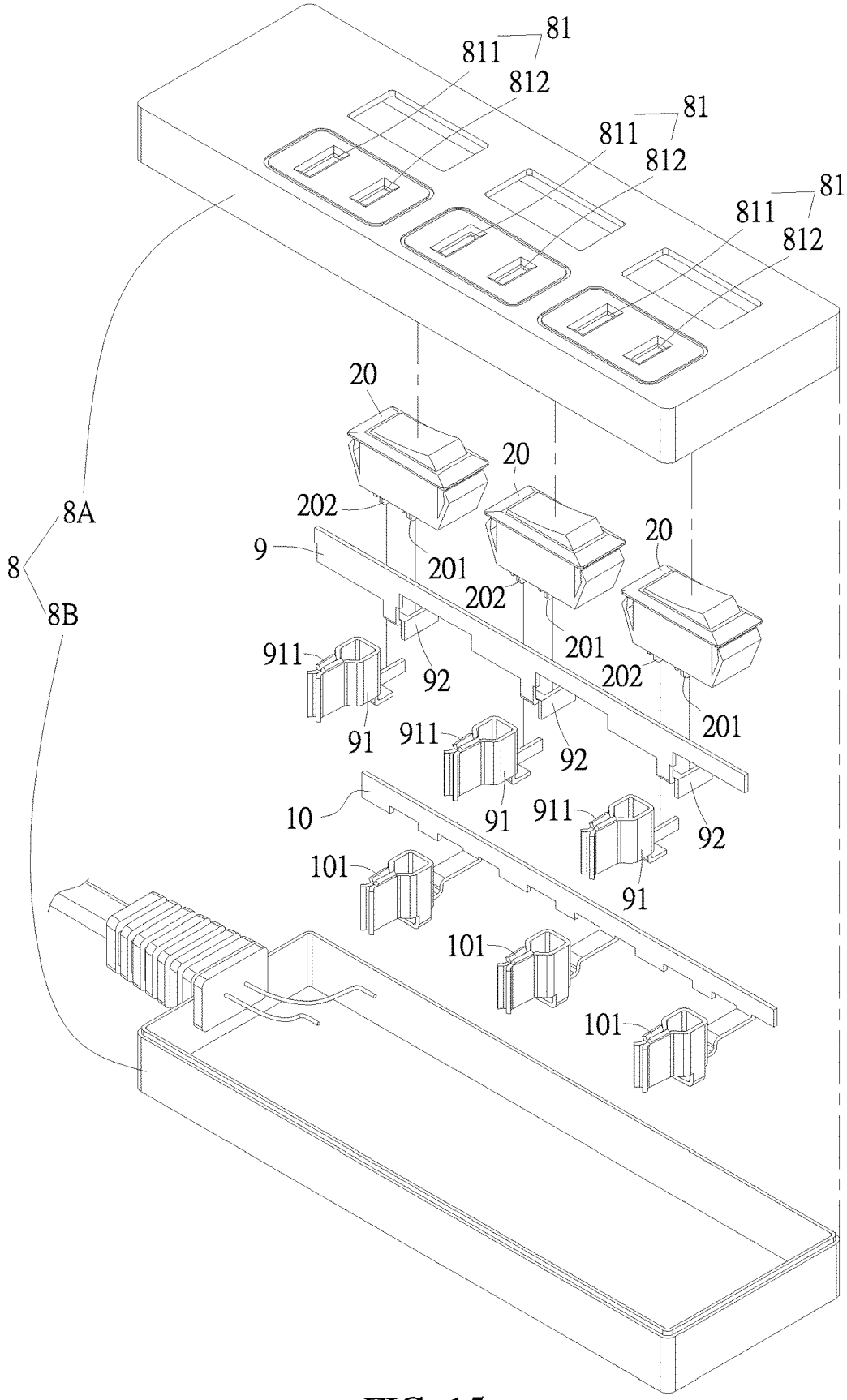
FIG. 15 is an exploded view of a heat destructive disconnecting switch of a fifth embodiment of the present invention applied in an extension cord socket.
Figure 16:
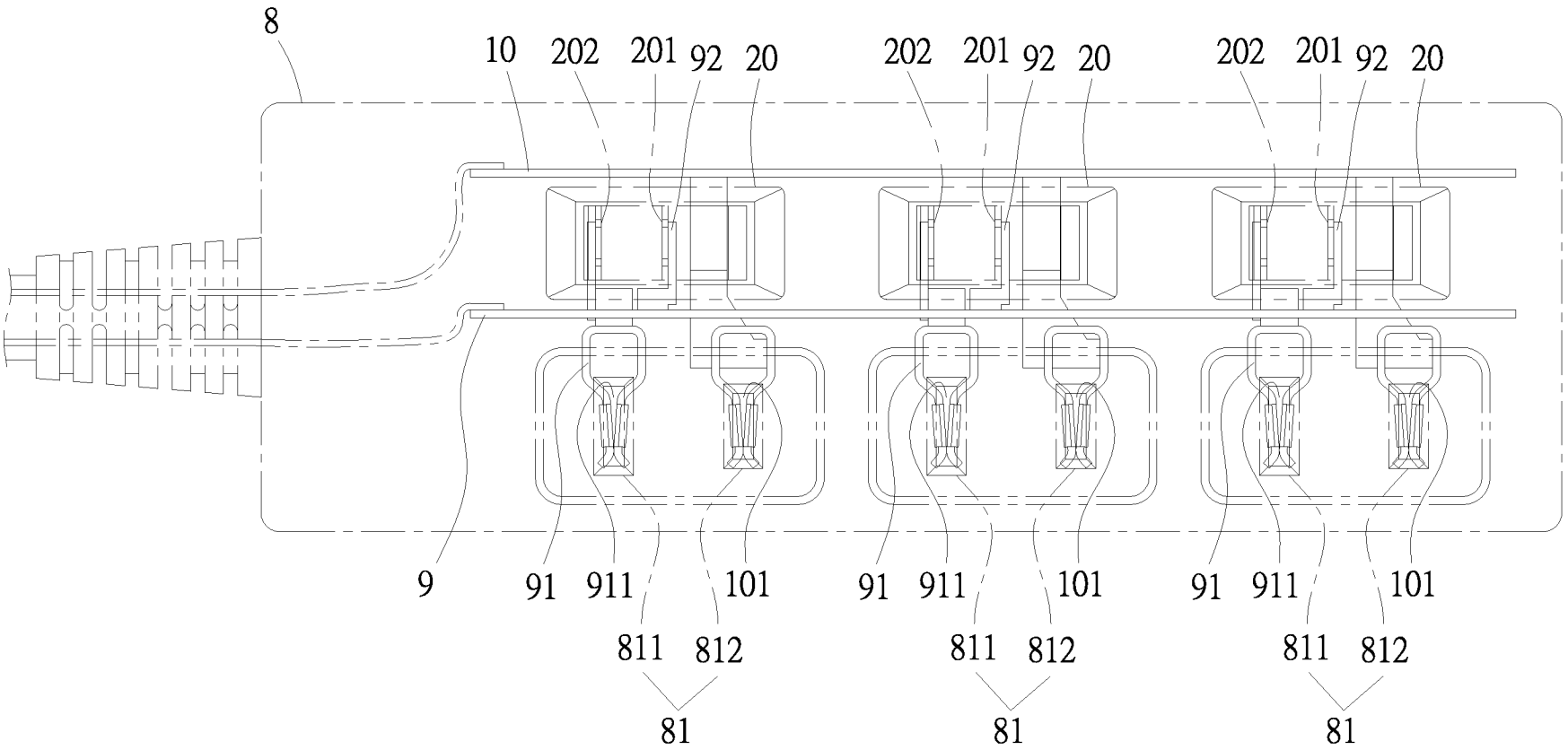
FIG. 16 is a structural view of the heat destructive disconnecting switch of the fifth embodiment of the present invention used in an extension cord socket.

Referring to FIG. 15 and FIG. 16, which show a fifth embodiment of the present invention, wherein the present embodiment applies the overheating destructive switch of the above-described embodiment in a plug socket provided with switches. More specifically, the present embodiment is applied in an extension cord socket comprising three socket apertures (81), wherein the extension cord socket comprises:

A casing (8), which is provided with an upper casing (8A) and a lower casing (8B). The upper casing member (8A) comprises the three socket apertures (81), and each of the socket apertures (81) comprises a live wire socket (811) and a neutral wire socket (812).

A live wire conductive member (9), which is installed in the casing (8), and the live wire conductive member (9) is provided with three spaced live wire connecting ends (92) corresponding to three independent live wire insert pieces (91). Each of the live wire insert pieces (91) comprises a live wire slot (911), and the live wire slots (911) correspond to the live wire sockets (811), A neutral wire conductive member (10), which is installed in the casing (8), and the neutral wire conductive member (10) is provided with three spaced neutral wire slots (101). The neutral wire slots (101) respectively correspond to the neutral wire sockets (812).

Three overheating destructive switches (20), which are as described in the above-described first embodiment to the fourth embodiment, wherein a first conductive member (201) of the overheating destructive switch (20) is connected to the live wire connecting end (92) of the live wire conductive member (9) or the live wire insert piece (91). The second conductive member (202) is then connected to the live wire insert piece (91) or the live wire connecting end (92) of the live wire conductive member (9). In the present embodiment, as an example, the first conductive member (201) is connected to the live wire insert piece (91), and the second conductive member (202) is connected to the live wire connecting end (92) of the live wire conductive member (9) (the characteristics of the connecting method for this portion has already been described in the above embodiments, and thus not further detailed herein). Accordingly, when there is a temperature anomaly in the operating temperature resulting in a rise in temperature in any one of the live wire insert pieces (91) of the extension cord socket, the heat energy is transferred to the overheating destructive switch (20) associated therewith through the first conductive member (201) or the second conductive member (202), causing the overheating destructive switch (20) to break the circuit due to overheating and cutting off the supply of power, that is, the live wire insert piece (91) with an abnormal temperature immediately cuts off the supply of power, stopping the operating temperature from continuing to rise and enabling the operating temperature to slowly fall. Because each of the overheating destructive switches (20) independently controls a set of the live wire socket (811) and neutral wire socket (812), thus, when one of the overheating destructive switches (20) cuts off the power supply due to overheating, the other sets of live wire sockets (811) and neutral wire sockets (812) can still continue to operate as normal.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An overheating destructive switch, comprising:

a base, which is provided with a holding space;

a first conductive member, which penetrates and is mounted on the base;

a second conductive member, which penetrates and is mounted on the base;

a movable conductive member, which is mounted within the holding space, and is electrically connected to the first conductive member and selectively connects with the second conductive member;

an overheating destructive member, comprising an awaiting destructive portion and a support portion, the awaiting destructive portion is destructed under a fail temperature condition, the support portion is joined to the awaiting destructive portion, an axial peripheral space of the support portion defines a displacement space, the awaiting destructive portion is positioned on an outer edge of the support portion, and the awaiting destructive portion is positioned beyond the displacement space;

a first elastic member, which butt joins to the awaiting destructive portion, and under the fail temperature condition, the first elastic member butts against the awaiting destructive portion and thereby causing the awaiting destructive portion displaced toward the displacement space;

an operating component, which is assembled on the base, the operating component comprises an operating member and the first elastic member, the operating member comprises a retaining tubular portion and a contact member, the retaining tubular portion is provided with an opening, the overheating destructive member is fixedly disposed at an assembly position of the opening, the first elastic member is positioned within the retaining tubular portion, a first end of the first elastic member contacts the awaiting destructive portion, the contact member contacts the movable conductive member, the first elastic member is compressed and confined between the contact member and the overheating destructive member and is provided with a first elastic force;

a second elastic member, which is provided with a second elastic force, the second elastic force acts on the operating member;

whereby, when the operating member is at a first position, the first elastic force forces the contact member to butt against the movable conductive member, causing the movable conductive member to contact the second conductive member and form a power-on state;

when in the power-on state, an electric current passes through the first conductive member, the movable conductive member, and the second conductive member producing heat energy, the heat energy is transferred to the overheating destructive member through the contact member and the first elastic member, the awaiting destructive portion absorbs the heat energy and is destructed under a fail temperature condition, causing the first elastic member to press the awaiting destructive portion, the awaiting destructive member is thus displaced toward the displacement space, resulting in lessening or loss of the first elastic force, at which time the second elastic force is larger than the first elastic force; the second elastic force thus forces the operating member to displace to a second position, thereby causing the movable conductive member to separate from the second conductive member and form a power-off state.

2. The overheating destructive switch according to claim 1, wherein the awaiting destructive portion and the support portion are formed as an integral body from the same material.

3. The overheating destructive switch according to claim 1, wherein the awaiting destructive portion and the support portion are made of different materials, and the temperature that causes the support portion to be destructed due to overheating is defined as a support portion destructive temperature; the support portion destructive temperature is relatively higher than the fail temperature.

4. The overheating destructive switch according to claim 1, wherein a mounting portion protrudes from the awaiting destructive portion toward the first elastic member, and is used to mount the first elastic member thereon.

5. The overheating destructive switch according to claim 1, wherein the operating member further comprises a limiting member; the limiting member is a cylinder body that defines a space, and the limiting member butts against the overheating destructive member, which fixedly disposes the overheating destructive member at the assembly position; the first elastic member is fitted inside the space.

6. The overheating destructive switch according to claim 1, wherein the first elastic member is a spring, and a first end of the first elastic member is mounted on a mounting portion of the overheating destructive member.

7. The overheating destructive switch according to claim 1, wherein the contact member is a hollow shaped heat conducting member, a contact end thereof contacts the movable conductive member, and a second end of the first elastic member extends into the contact member.

* * * * *